US009889571B2

(12) United States Patent
Nicholas

(10) Patent No.: US 9,889,571 B2
(45) Date of Patent: Feb. 13, 2018

(54) RAZOR CARTRIDGE WITH A LUBRICATION MEMBER HAVING A PRINTED SUPPORT STRUCTURE

(71) Applicant: The Gillette Company, Boston, MA (US)

(72) Inventor: Andrew Charles Nicholas, Winchester, MA (US)

(73) Assignee: The Gillette Company LLC, Boston, MA (US)

( * ) Notice: Subject to any disclaimer, the term of this patent is extended or adjusted under 35 U.S.C. 154(b) by 180 days.

(21) Appl. No.: 14/964,636

(22) Filed: Dec. 10, 2015

(65) Prior Publication Data

US 2016/0199991 A1 Jul. 14, 2016

Related U.S. Application Data

(60) Provisional application No. 62/101,005, filed on Jan. 8, 2015.

(51) Int. Cl.
*B26B 21/44* (2006.01)

(52) U.S. Cl.
CPC ..... *B26B 21/443* (2013.01)

(58) Field of Classification Search
CPC ..... B26B 21/443
See application file for complete search history.

(56) References Cited

U.S. PATENT DOCUMENTS

| | | | | |
|---|---|---|---|---|
| 5,915,791 | A * | 6/1999 | Yin | B26B 21/4018 30/41 |
| 6,161,287 | A * | 12/2000 | Swanson | B26B 21/225 30/47 |
| 6,923,115 | B1 | 8/2005 | Litscher et al. | |
| 8,104,887 | B2 | 1/2012 | Albrecht et al. | |
| 8,418,608 | B2 | 4/2013 | Preckel | |
| 9,314,953 | B2 * | 4/2016 | Lauer | B29C 47/0069 |
| 2002/0000041 | A1 | 1/2002 | Doroodian-Shoja | |
| 2004/0181943 | A1 * | 9/2004 | Kwiecien | B26B 21/443 30/41 |
| 2005/0246898 | A1 * | 11/2005 | Gilder | B26B 21/443 30/34.2 |

(Continued)

OTHER PUBLICATIONS

PCT Search Report with Written Opinion in the corresponding international application PCT/US/2016/012471 dated Apr. 13, 2016.

(Continued)

*Primary Examiner* — Hwei C Payer
(74) *Attorney, Agent, or Firm* — Kevin C. Johnson; Steven W. Miller

(57) ABSTRACT

A razor cartridge including a guard at a front portion of the cartridge, a cap at a back portion of the cartridge, at least one blade positioned between the guard and the cap, a top surface and an opposing bottom surface, and a lubricating member positioned in the cartridge at the top surface. The lubricating member has an exterior surface with a visible surface and a non-visible surface. A printed support structure is provided on the exterior surface of the lubricating member. The printed support structure covers a portion of the exterior surface to provide structural integrity for the lubricating member.

18 Claims, 12 Drawing Sheets

(56) References Cited

U.S. PATENT DOCUMENTS

| | | | | |
|---|---|---|---|---|
| 2008/0034590 | A1* | 2/2008 | Prudden, Jr. | B26B 21/4012 30/34.2 |
| 2009/0223057 | A1* | 9/2009 | Coope-Epstein | A61K 8/342 30/41 |
| 2011/0126413 | A1 | 6/2011 | Szczepanowski | |
| 2012/0000047 | A1 | 1/2012 | Jones | |
| 2012/0000074 | A1* | 1/2012 | Pazosschroeder | B26B 21/40 30/34.05 |
| 2014/0310960 | A1* | 10/2014 | Ariyanayagam | B26B 21/4068 30/34.05 |
| 2014/0323374 | A1 | 10/2014 | Stephens et al. | |
| 2016/0199990 | A1* | 7/2016 | Nicholas | B26B 21/443 30/538 |
| 2016/0199991 | A1* | 7/2016 | Nicholas | B26B 21/443 30/538 |
| 2016/0199992 | A1* | 7/2016 | Nicholas | B26B 21/4012 30/538 |

OTHER PUBLICATIONS

U.S. Appl. No. 14/964,626, filed Dec. 10, 2015, Andrew Charles Nicholas.
U.S. Appl. No. 14/964,641, filed Dec. 10, 2015, Andrew Charles Nicholas et al.
U.S. Appl. No. 12/629,249, filed Dec. 2, 2009, Andrew Anthony Szczepanowski et al.
U.S. Appl. No. 12/828,401, filed Jul. 1, 2010, Marta Pazos Schroeder.

* cited by examiner

RAZOR CARTRIDGE WITH A LUBRICATION MEMBER HAVING A PRINTED SUPPORT STRUCTURE

FIELD OF THE INVENTION

The invention relates to razors, and more particularly to razor cartridges having lubricating members with printed support structures.

BACKGROUND OF THE INVENTION

The use of shaving aids on razor blades to provide lubrication benefits during the shave is known. See e.g., U.S. Pat. Nos. 7,121,754; 6,298,558; 5,711,076; 5,134,775; 6,301,785; and U.S. Patent Publ. Nos. 2009/0223057 and 2006/0225285. These shaving aids are also commonly referred to as lubrication strips or lubrication members. These types of lubrication strips have been used for years in the shaving industry. The strips are typically extruded making them very cost effective. They may also be extruded in two or more colors to provide both a visual and a functional benefit. The visual benefits being limited by the capabilities of the extruder.

Extruded lubrication members are typically formed of a solid polymeric matrix. The solid polymeric matrix includes a water-soluble polymer and a water-insoluble polymer. The water-insoluble polymer provides the lubricating member with structural integrity. The amount of water-soluble polymer in the lubrication member is limited by the need for structural integrity provided by the water-insoluble polymer. This balance inherently limits the amount of water-soluble polymer in the lubrication member.

Different structures for delivering lubrication benefits have also been attempted. One such structure is a reservoir that is attached to the razor cartridge. The reservoir contains a lubricant in dry form. The skin engaging surface of the reservoir includes a plurality of apertures. The apertures allow water to enter the reservoir. Upon entering the reservoir, the water interacts with the dry lubricant to create a lubricant which flows out from the reservoir through the apertures to provide a lubricant to the user during shaving. The reservoir provides a support structure for the lubricant allowing it to be delivered to the user during the shave. While such reservoirs do provide structural support for the lubricant, they present the problem of high cost and assembly disadvantages compared to extruded lubrication strips.

It is an object of the invention to provide a lubrication member with a printed support structure to provide structural integrity for the lubricating member without the high cost and complexity associated with a reservoir.

SUMMARY OF THE INVENTION

An aspect of the invention relates to a razor cartridge. The razor cartridge includes a guard at a front portion of the cartridge, a cap at a back portion of the cartridge, at least one blade positioned between the guard and the cap, a top surface, and a lubricating member positioned at the top surface, the lubricating member having an exterior surface with an area. The exterior surface comprises a visible or top surface and a non-visible or bottom surface. A printed support structure is provided on the exterior surface of the lubricating member. The printed support structure covers a portion of the exterior surface of the lubricating member to provide structural integrity for the lubricating member.

The printed support structure may be printed on the visible surface and/or the non-visible surface.

The lubricating member may be positioned on said cap, on the guard or in the form of a ring surrounding the blade.

The printed support structure may be in the form of a pattern.

The printed support structure comprises a plurality of printed droplets.

The printed support structure covers from about 10% to about 90% of the area of the exterior surface, more preferably, the printed support structure covers from about 30% to about 70% of the area of the exterior surface, most preferably, the printed support structure covers from about 40% to about 60% of the area of the exterior surface.

The printed support structure comprises a UV curable ink.

The razor cartridge includes a guard at a front portion of said cartridge, a cap at a back portion of the cartridge, at least one blade positioned between the guard and the cap, a top surface, and a lubricating member positioned at the top surface, the lubricating member having an exterior surface with an area. The exterior surface comprises a top surface and a bottom surface. A printed support structure is provided on the lubricating member. The printed support structure covers a portion of the exterior surface of the lubricating member to provide structural integrity for the lubricating member. The printed support structure may be printed on the bottom surface and/or the top surface of the lubricating member.

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

DETAILED DESCRIPTION OF THE INVENTION

Figure 1:
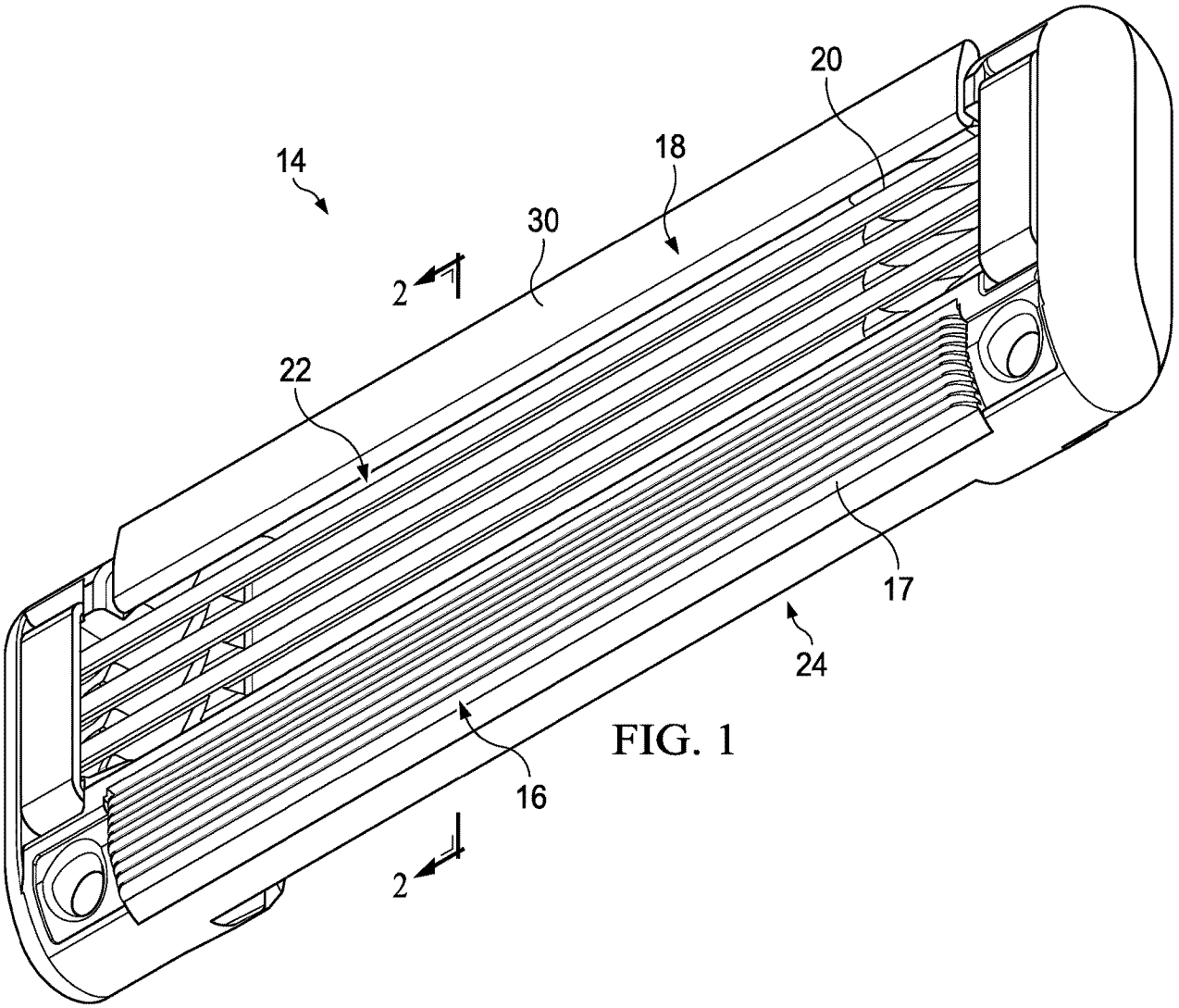
FIG. 1 is a perspective view of a razor cartridge of the present invention.
Figure 2:
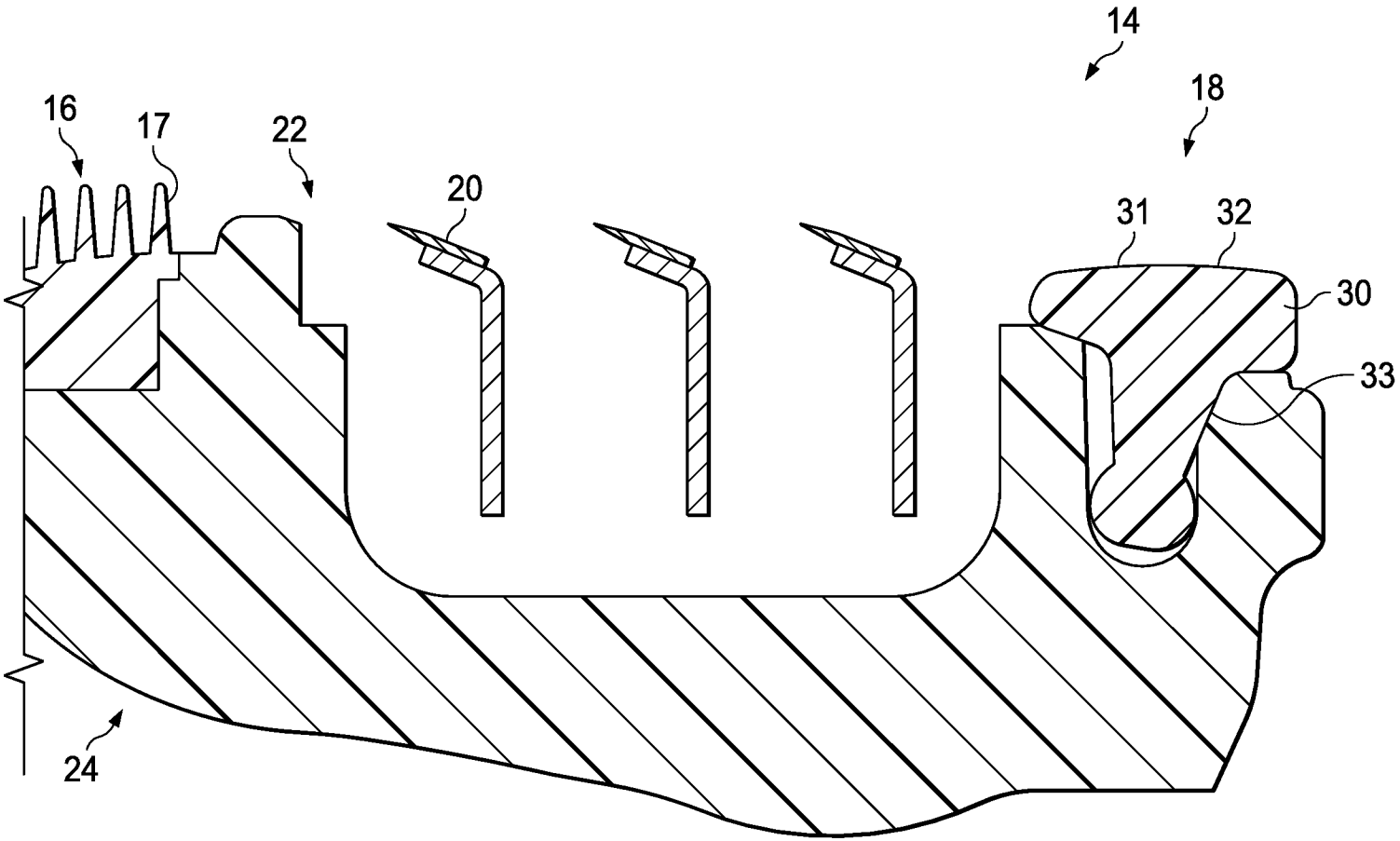
FIG. 2 is a sectional view taken along line 2-2 of FIG. 1.
Figure 3:
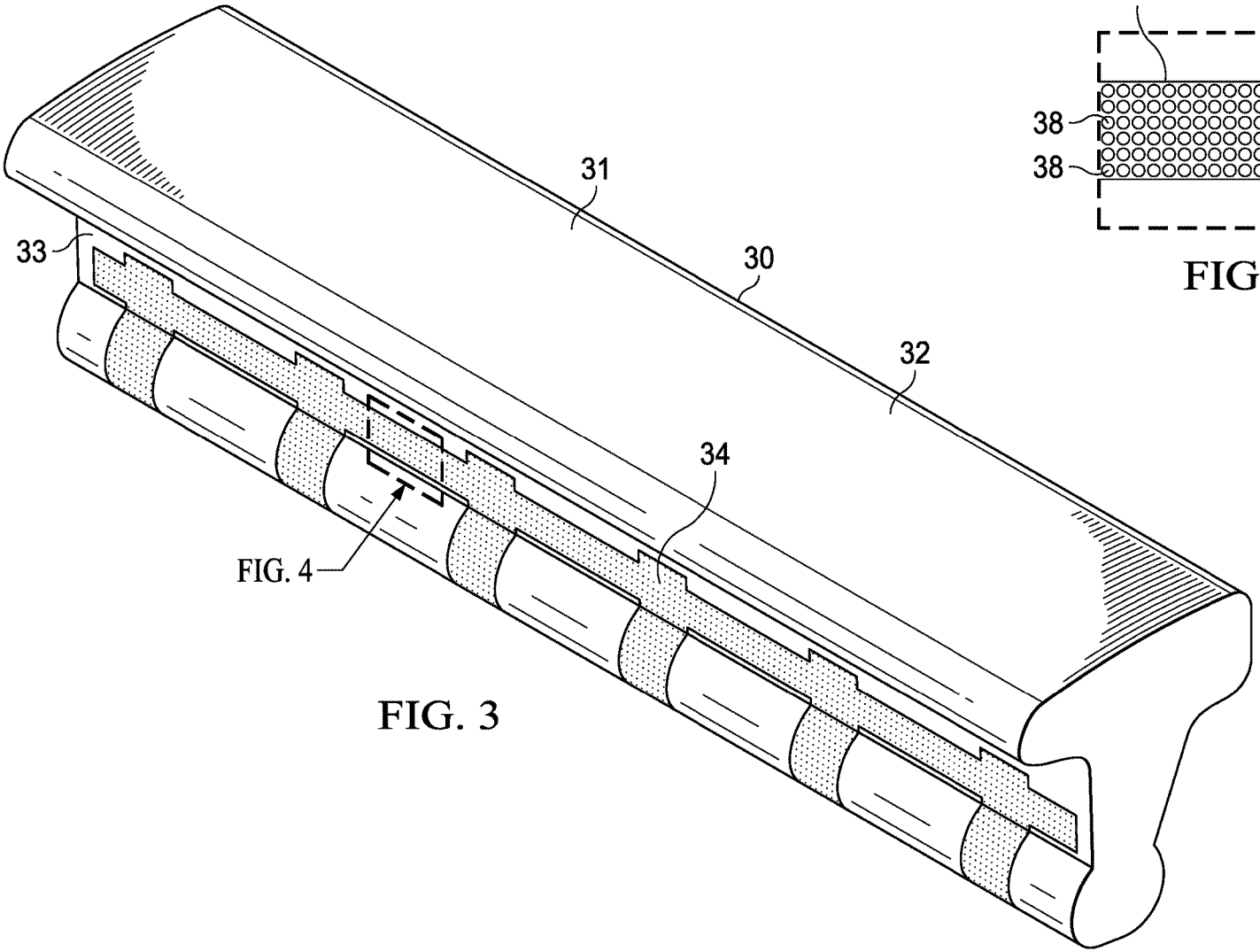
FIG. 3 is a perspective view of a lubricating member of the present invention.

Referring to FIGS. 1-3, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. A lubricating member 30 is positioned on the top surface 22 of the cartridge 14. Lubricating member 30 comprises an exterior surface 31. The exterior surface 31 comprises a visible or top surface 32 and a non-visible or bottom surface 33. The visible or top surface 32 is the portion of the exterior surface 31 that is visible to a user when viewing the cartridge 14. The non-visible surface or bottom surface 33 is the portion of the exterior surface 31 that is not visible to a user when viewing the cartridge 14.

The guard 16 may include one or more elongated flexible protrusions 17 to engage a user's skin. The flexible protrusions 17 include flexible fins generally parallel to the one or more elongated blades 20. In another embodiment, the flexible fins have at least one portion which is not generally parallel to the one or more elongated edges. Non-limiting examples of suitable guards include those used in current razor blades and include those disclosed in U.S. Pat. Nos. 7,607,230 and 7,024,776; (disclosing elastomeric/flexible fin bars) and U.S. Patent Publ. Nos. 2008/0034590 (disclosing curved guard fins) and 2009/0049695 A1 (disclosing an elastomeric guard having a guard forming at least one passage extending between an upper surface and a lower surface).

The lubricating member 30 along with guard 16, cap 18 and blades 20 form the skin engaging portion of the cartridge 14. The lubricating member 30 is preferably locked in (via adhesive, a fitment, or melt bonding) an opening or on a plate or other surface of the cartridge 14.

The lubricating member 30 is located on the cartridge such that the lubricating member 30 contacts or engages the skin during the hair removal process, forward and/or aft of the blades and/or along the sides of the cartridge between the forward and aft portions. A feature "forward" of the one or more elongated blade edges, for example, is positioned so that the surface to be treated by the cartridge or hair removal device encounters the feature before it encounters the elongated blade edges. A feature "aft" of the elongated edge(s) is positioned so that the surface to be treated by the cartridge or hair removal device encounters the feature after it encounters the elongated blade edges. In FIGS. 1-2 the lubricating member 30 is positioned aft of the blades 20 on the cap 18. Where more than one lubricating member is provided on the cartridge, the lubricating members can be the same or different. By different, meaning having a different size, a different shape, a different composition, and/or a different function.

In one embodiment, the lubricating member 30 comprises a solid polymeric matrix comprising a water-soluble polymer material having a melting point of from about 150° C. to about 250° C. and optionally a water-insoluble polymer material. In one embodiment, the matrix comprises a water soluble polymer comprising at least one of a polyethylene oxide, polyvinyl pyrrolidone, polyacrylamide, polyhydroxymethacrylate, polyvinyl imidazoline, polyethylene glycol, polyvinyl alcohol, polyhydroxyethymethacrylate, silicone polymers, and mixtures thereof. In one embodiment, said water soluble polymer is selected from the group consisting of polyethylene oxide, polyethylene glycol, and a mixture thereof.

The lubricating member 30 may comprise other ingredients commonly found in commercially available lubricating members, such as those used on razor cartridges by Gillette, Schick or BIC. Non-limiting examples of such lubricating members include those disclosed in U.S. Pat. Nos. 6,301,785; 6,442,839; 6,298,558 and 6,302,785, and U.S. Patent Publ. Nos. 2008/060201 and 2009/0223057. The lubricating member may also comprise an ingredient selected from the group consisting of polyethylene oxide, polyvinyl pyrrolidone, polyacrylamide, hydroxypropyl cellulose, polyvinyl imidazoline, polyethylene glycol, poly vinyl alcohol, polyhydroxyethylmethacrylate, silicone copolymers, sucrose stearate, vitamin E, soaps, surfactants, panthenol, aloe, plasticizers, such as polyethylene glycol; beard softeners; additional lubricants, such as silicone oil, Teflon® polytetrafluoroethylene powders (manufactured by DuPont), and waxes; essential oils such as menthol, camphor, eugenol, eucalyptol, safrol and methyl salicylate; tackifiers such as Hercules Regalrez 1094 and 1126; non-volatile cooling agents, inclusion complexes of skin-soothing agents with cyclodextrins; fragrances; antipruritic/counterirritant materials; antimicrobial/keratolytic materials such as Resorcinol; anti-inflammatory agents such as Candilla wax and glycyrrhetinic acid; astringents such as zinc sulfate; surfactants such as pluronic and iconol materials; compatibilizers such as styrene-b-EO copolymers; mineral oil, polycaprolactone (PCL), and combinations thereof.

The water-soluble polymer will preferably comprise at least 50%, more preferably at least 60%, by weight of the skin engaging member, up to about 99%, or up to about 90% of the matrix. The more preferred water soluble polymers are the polyethylene oxides generally known as POLYOX (available from Dow or ALKOX (available from Meisei Chemical Works, Kyoto, Japan). These polyethylene oxides will preferably have mol.wt.s of about 100,000 to 6 million, most preferably about 300,000 to 5 million. The most preferred polyethylene oxide comprises a blend of about 40 to 80% of polyethylene oxide having an average mol.wt. of about 5 million (e.g. POLYOX COAGULANT) and about 60 to 20% of polyethylene oxide having an average mol.wt. of about 300,000 (e.g. POLYOX WSR-N-750). The polyethylene oxide blend may also advantageously contain up to about 10% by weight of a low mol.wt. (i.e. MW<10,000) polyethylene glycol such as PEG-100.

The matrix may comprise from about 0.5% to about 50%, preferably from about 1% to about 20%, polycaprolactone (preferably mol.wt. of 30,000 to 60,000 daltons). See U.S. Pat. No. 6,302,785.

The lubricating member may contain other conventional ingredients, such as low mol.wt. water-soluble release enhancing agents such as polyethylene glycol (MW<10,000, e.g., 1-10% by weight PEG-100), water-swellable release enhancing agents such as cross-linked polyacrylics (e.g., 2-7% by weight), colorants, antioxidants, preservatives, vitamin E, aloe, cooling agents, essential oils, beard softeners, astringents, medicinal agents, etc.

The matrix can further comprise a water-insoluble polymer in which the water-soluble polymer is dispersed. Preferably, at a level of from about 0% to about 50%, more preferably about 5% to about 40%, and most preferably about 15% to about 35% by weight of the skin engaging member is a water-insoluble polymer. Suitable water-insoluble polymers which can be used include polyethylene (PE), polypropylene, polystyrene (PS), butadiene-styrene copolymer (e.g. medium and high impact polystyrene), polyacetal, acrylonitrile-butadiene-styrene copolymer, ethylene vinyl acetate copolymer, polyurethane, and blends thereof such as polypropylene/polystyrene blend or polystyrene/impact polystyrene blend.

One preferred water-insoluble polymer is polystyrene, preferably a general purpose polystyrene or a high impact polystyrene such as Styrenics 5410 from Ineos (i.e. polystyrene-butadiene), such as BASF 495F KG21. The water-insoluble polymer provides mechanical strength to the lubricating member for production and during use.

The lubricating member may be made by extrusion or another high temperature processing, such as injection molding, compacting, ultrasonic or radio frequency sintering, and slot coating.

The blended components of the lubricating member may be extruded through a Haake System 90, ¾ inch diameter extruder with a barrel pressure of about 1000-2000 psi, a rotor speed of about 10 to 50 rpm, and a temperature of about 150°-185° C. and a die temperature of about 170°-185° C. Alternatively, a ¼ inch single screw extruder may be employed with a processing temperature of 175°-200° C., preferably 185°-190° C., a screw speed of 20 to 50 rpm, preferably 25 to 35 rpm, and an extrusion pressure of 1800 to 5000 psi, preferably 2000 to 3500 psi. The extruded strip is air cooled to about 25° C. To injection mold the strips it is preferred to first extrude the powder blend into pellets. This can be done on a 1¼ or 1½ inch single screw extruder at a temperature of 120°-180° C., preferably 140°-150° C., with a screw speed of 20 to 100 rpm, preferably 45 to 70 rpm. The pellets are then molded in either a single material molding or multi-material molding machine, which may be single cavity or multi-cavity, optionally equipped with a hot-runner system. The process temperature can be from 165° to 250° C., preferably from 180° to 225° C. The injection pressure should be sufficient to fill the part completely without flashing. Depending on the cavity size, configuration and quantity, the injection pressure can range from 300 to 2500 psi. The cycle time is dependent on the same parameters and can range from 3 to 30 seconds, with the optimum generally being about 6 to 15 seconds. In one embodiment, one or more feeds can be preheated or they can be fed in at ambient temperature.

In one embodiment, the lubricating member is a soap formulation and can be molded to create its shape. Non-limiting examples of suitable soap formulations include the soap wings present on Venus Breeze® line of 2-in-1 razor, and/or the moisturizing solid on the Schick® Intuition® line of razors.

The exterior surface 31 of lubricating member 30 includes a printed support structure 34. The printed support structure 34 shown in FIG. 3 is in the form of a pattern covering a portion of the exterior surface 31 of the lubricating member 30. The printed support structure 34 covers a portion of the non-visible or bottom surface 33 of the lubricating member 30.

The printed support structure 34 provides the lubricating member 30 with structural integrity allowing the lubricating member to be handled during production and secured to cartridge 14. The printed support structure 34 also provides the lubricating member 30 with structural integrity during use especially when brought into contact with water during shaving. While providing structural integrity for the lubricating member 30 support structure 34 also allows for the addition of a greater amount of water-soluble polymer to be included in lubricating member 30.

The printed support structure 34 preferably covers from about 10% to about 90% of the area of the exterior surface, more preferably covers from about 30% to about 70% of the area of the exterior surface, and most preferably covers from about 40% to about 60% of the area of the exterior surface.

Figure 4:
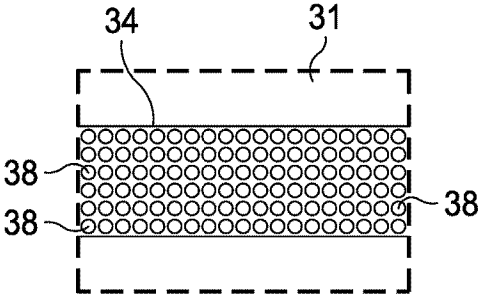
FIG. 4 is an enlarged view of a portion of the lubricating member shown in FIG. 3.

Referring now to FIG. 4, the printed support structure 34 on the exterior surface 31 comprises a plurality of printed droplets 38. The size of the printed droplets 38 may be consistent throughout the printed support structure 34. The size of the printed droplets 38 may vary throughout the printed support structure.

The printed droplets may be applied with a suitable type of device including, but not limited to print heads, nozzles, and other types of material deposition devices. Any suitable type of print heads can be used including, but not limited to ink jet print heads. In certain embodiments, the deposition device is an ink jet print head. The print heads may be of a non-contacting, digital type of deposition device. By "non-contacting", it is meant that the print heads do not contact the surface to be printed. By "digital", it is meant that the print heads can apply droplets of ink only where needed such as to form a pattern in the form of words, figures (e.g., pictures), or designs.

Ink jet print heads will typically comprise multiple nozzles. The nozzles are generally aligned in rows and are configured to jet ink in a particular direction that is generally parallel to that of the other nozzles. The nozzles within each row on a print head can be aligned linearly. Alternatively, the nozzles may be in one or more rows that are oriented diagonally relative to the longer dimension (or length) of the print head. Both such arrangements of nozzles can be considered to be substantially linearly arrayed. The ink jet print heads can comprise any suitable number and arrangement of nozzles therein. One suitable inkjet print head contains approximately 360 nozzles per inch (per 2.54 cm). The Xaar 1001 is an example of a suitable print head for use herein, and is available from Xaar of Cambridge, UK.

The droplets of ink can range in diameter from about 10 microns or less to about 200 microns, or more. The droplets of ink can be distributed in any suitable number over a given area. Typically, in ink jet printing, the ink droplets form a matrix in which the number of drops per inch (DPI) is specified in the direction of movement of the print head or article to be printed, and in a direction on the surface of the article perpendicular thereto. The application of ink droplets provided on the surface of the lubricating member to form a solid image can range from about 80, or less up to about 2,880 or more droplets per inch (DPI) in at least one direction.

The apparatus can comprise a printing apparatus with any suitable number, arrangement, and type of print heads. For example, the apparatus may comprise between 1-20, or more, print heads. The print heads may be arranged in a spaced apart relationship. Alternatively, one or more of the print heads may be positioned adjacent and in contact with another one of the print heads.

If there is more than one print head, the different print heads can print cyan, magenta, yellow, and black or any other combination of desired colors.

Other types of application techniques may also be used. Examples of other application techniques include but are not limited to spraying, roller printing, rolling, transfer printing, and laser printing. The application technique is to deliver an ink or substance that is transferred directly on the lubricating member to provide the lubricating member with structural integrity.

The ink of the present invention is preferably an ultraviolet (UV) curable ink. UV curable inks are generally monomer/oligomer based with photosensitive molecules that initiate a polymerization reaction (e.g. curing) when exposed to UV light. This reaction is near instantaneous once the ink lands on a substrate. The cross linking that occurs during curing provides a durable ink with good adhesion to the substrate.

Suitable types of UV curable ink that may be used include free radical and cationic. Both free radical and cationic UV inks are cured when exposed to UV light. When free radical inks are exposed to UV light a photoinitiator absorbs the UV light generating free radicals which react with double bonds causing chain reaction and polymerization. When cationic inks are exposed to UV light a photoinitiator absorbs the UV light generating a Lewis acid which reacts with epoxy groups resulting in polymerization.

Other types of UV curable inks may also be used. Examples of such UV curable inks include but are not limited to hybrid UV/water inks and hybrid UV/oil inks.

The high cure rates of UV curable inks translate into very high operating speeds. Thus, UV curable inks can be advantageously run on high-speed production equipment without having to allow for excessively large dryers, as would be necessary for other ink systems. The rapid cure rate also allows UV curable inks to be used to provide multiple layers in succession without having to move the substrate after each layer. This in turn allows for elevation, structuring, texturing, and colors to be easily incorporated.

Figure 5:
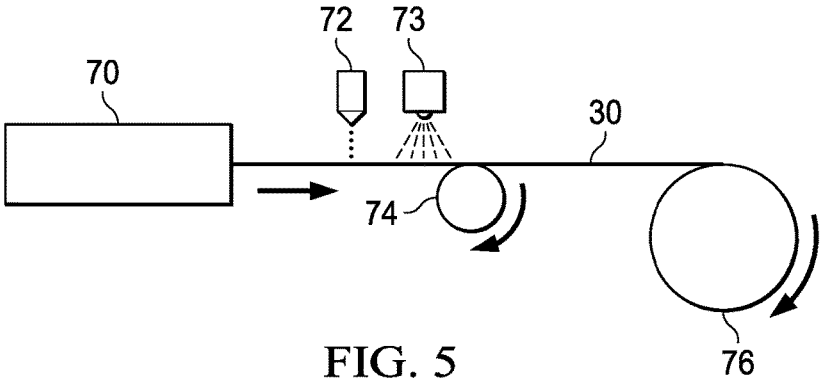
FIG. 5 is a side view of a printing process of the present invention.

Referring to FIG. 5, there is shown an extruder 70 extruding a lubricating member 30. Printing station 72 containing multiple print heads prints ink in the form of droplets 38 on lubricating member 30, such as shown in FIG. 4. A light unit 73 directs UV light toward lubricating member 30 to cure the ink. Lubricating member is supported by roller 74 until taken up by wind up roll 76.

After the lubrication member has been provided, by extrusion in this example, a support structure is then applied to the exterior surface of the lubricating member. The lubrication member may be provided by other techniques such as molding. The support structure may be applied by the aforementioned techniques.

Figure 6:
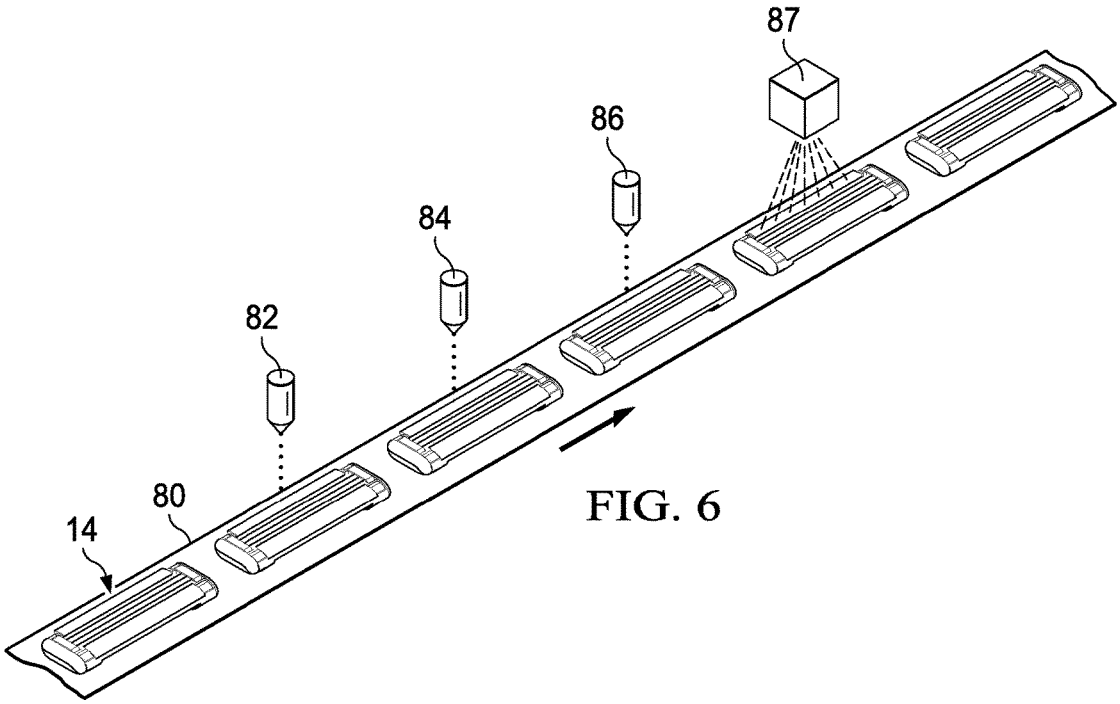
FIG. 6 is a side view of a printing process of the present invention.

Referring to FIG. 6, there is shown a web 80 carrying independent cartridges 14 such as shown in FIG. 1. Cartridges 14 pass under print stations 82, 84 and 86 which print ink in the form of droplets 38 on lubricating member 30 such as shown in FIG. 4. A light unit 87 directs UV light toward cartridge 14 to cure the ink. Cartridges 14 can then be passed to the next processing station by web 80.

Figure 7:
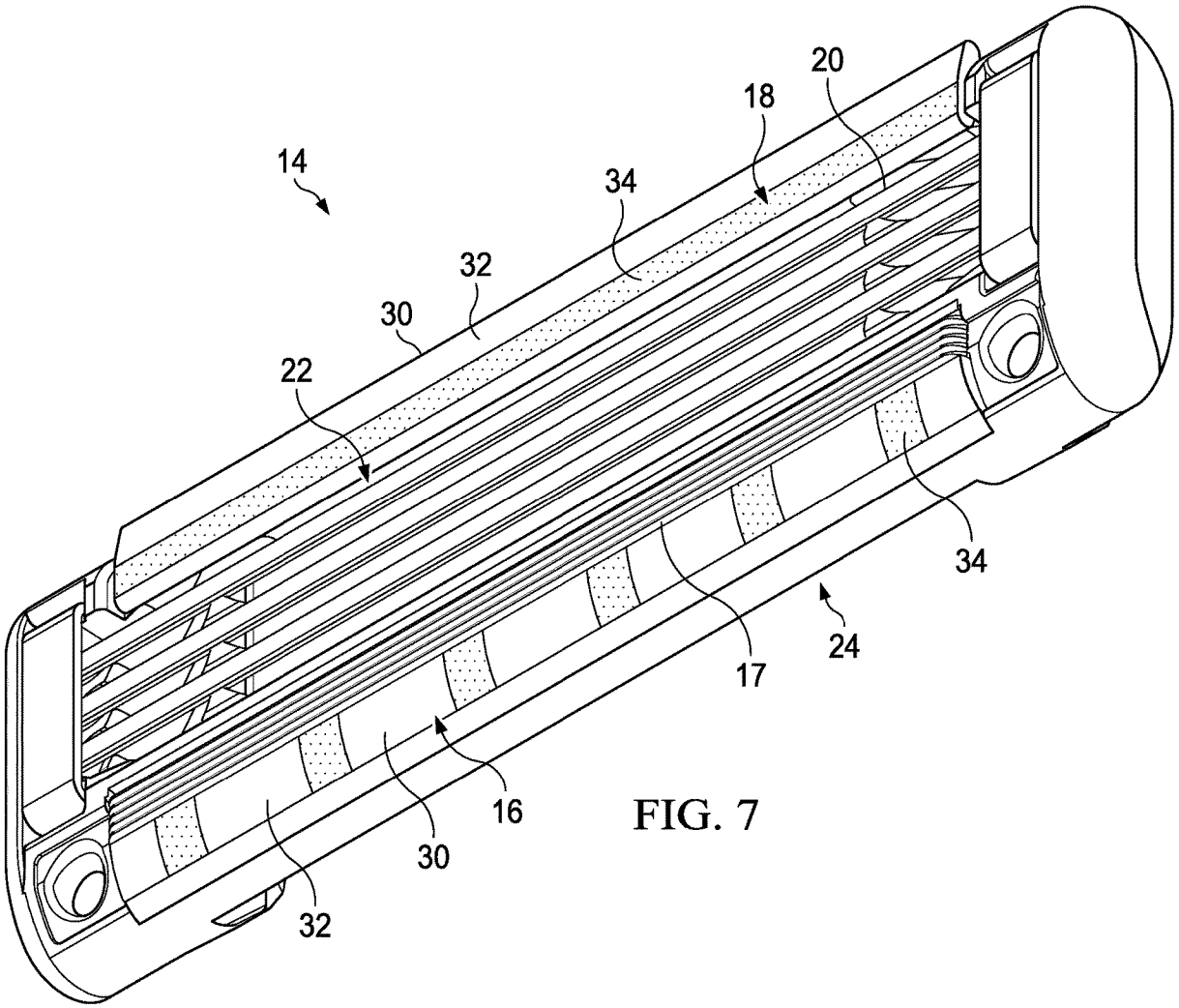
FIG. 7 is a perspective view of another razor cartridge of the present invention.

Referring to FIG. 7, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating members 30 are positioned on the top surface 22 of the cartridge 14. Lubricating members 30 each have a visible or top surface 32. The guard 16 includes flexible protrusions 17 in the form of flexible fins extending generally parallel to the one or more elongated blades 20.

The lubricating members 30 along with guard 16, cap 18 and blades 20 form skin engaging portions of the cartridge 14. The lubricating members 30 are located on the cartridge such that the lubricating members 30 contact or engage the skin during the hair removal process. The lubricating members 30 are positioned both forward and aft of the blades 20. The lubricating members 30 are positioned on the guard 16 and cap 18, respectively.

Figure 7A:
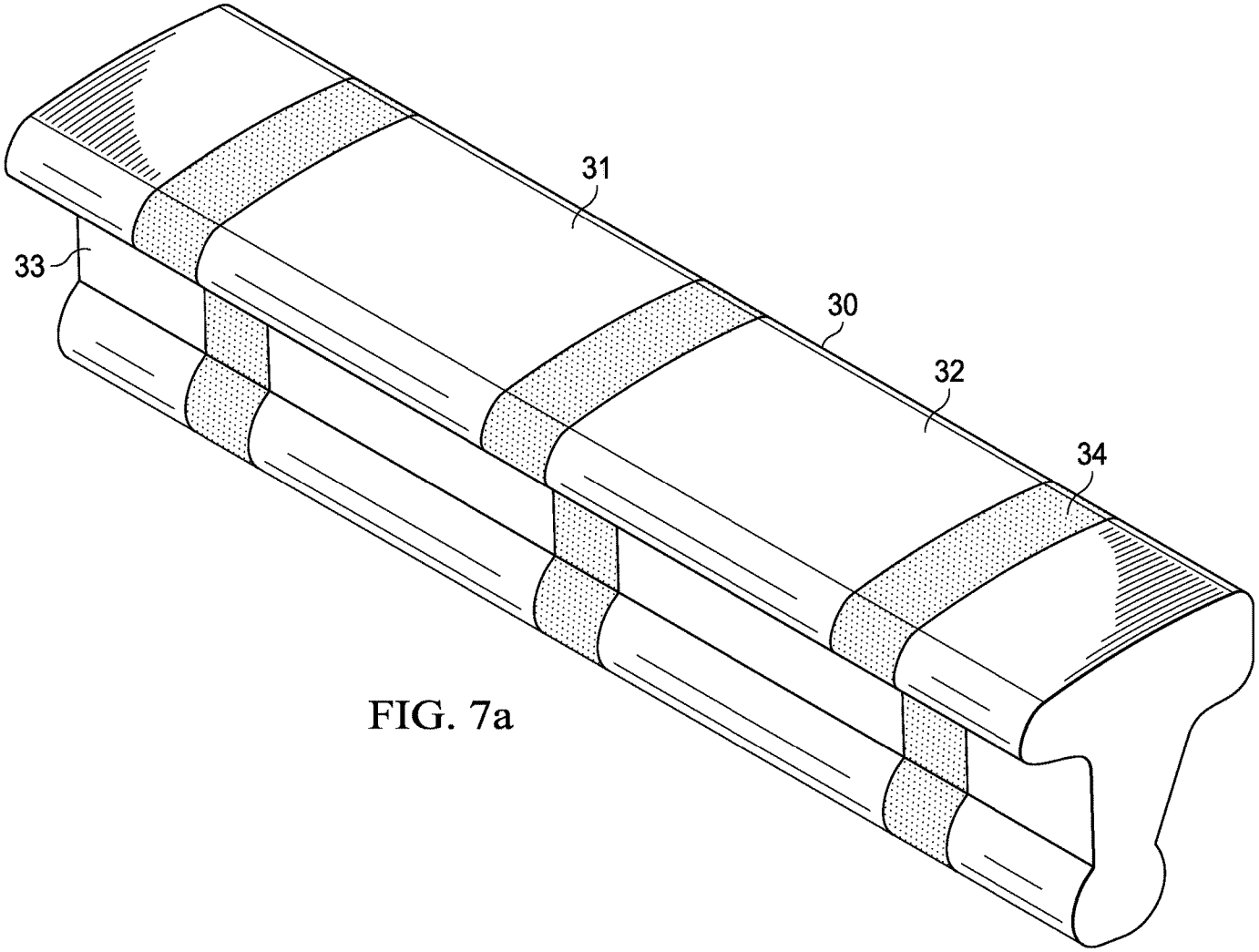
FIGS. 7*a* and 7*b* are perspective views of the lubricating members of the razor cartridge of FIG. 7.
Figure 7B:
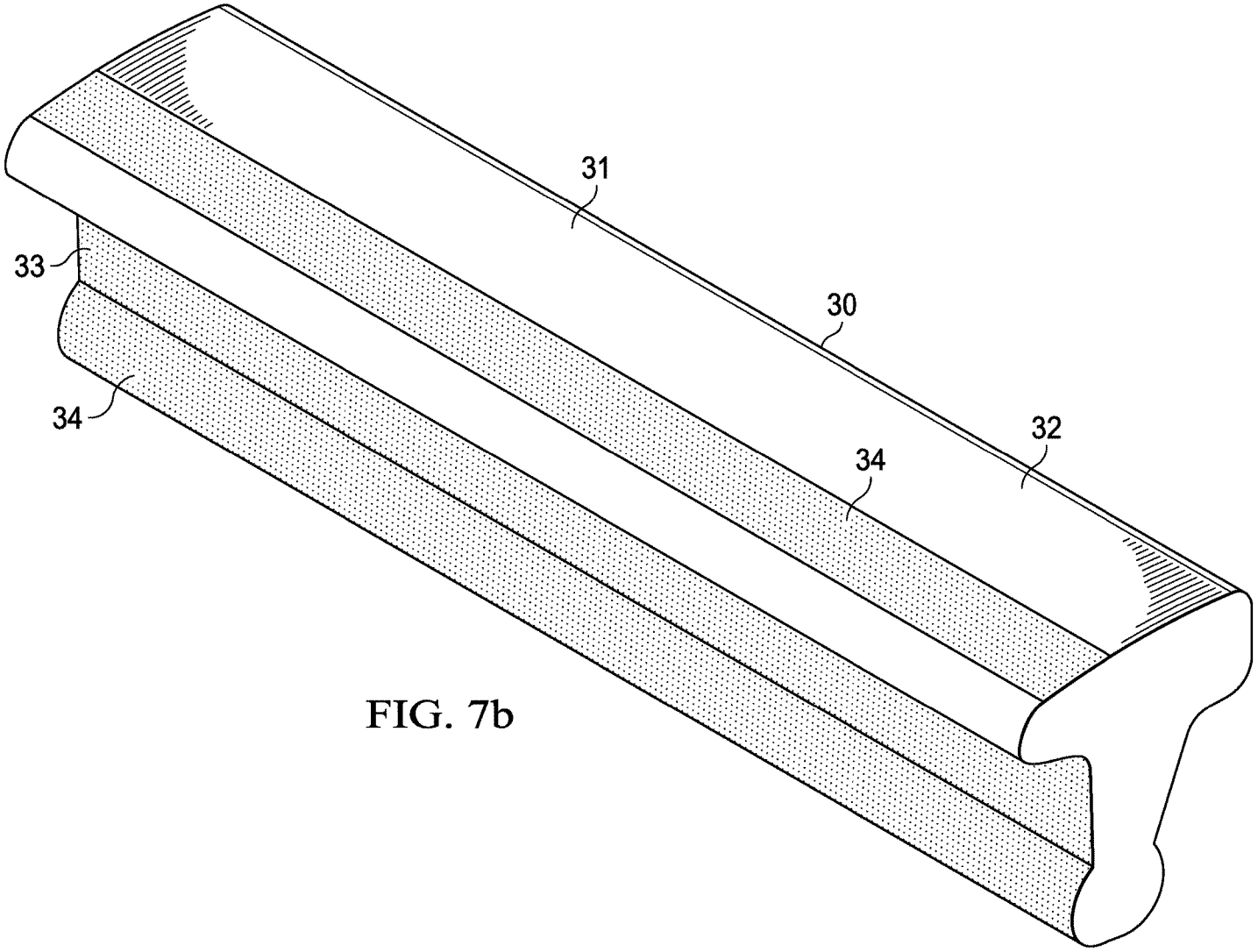

The visible surfaces 32 of lubricating members 30 include printed support structures 34. Referring to FIGS. 7 and 7*a*, the printed support structure 34 on the exterior surface 31 of the lubricating member 30 in the guard 16 comprises a plurality of spaced apart segments extending along the length of the visible or top surface 32 and non-visible or bottom surface 33 of lubricating member 30. The plurality of spaced apart support structures 34 on the guard from a pattern. Referring to FIGS. 7 and 7*b*, the printed support structure 34 on the exterior surface 31 of the lubricating member 30 in the cap 18 comprises a continuous strip extending along the length of the visible or top surface 32 and along the length of the non-visible or bottom surface 33 of lubricating member 30. As shown in FIG. 4, printed support structure 34 comprises a plurality of individual printed droplets 38. It may be desirable to have the printed support structure 34 only on the top surface 32. Alternatively, it may be desirable to have the printed support structure 34 only on the bottom surface 34.

Figure 8:
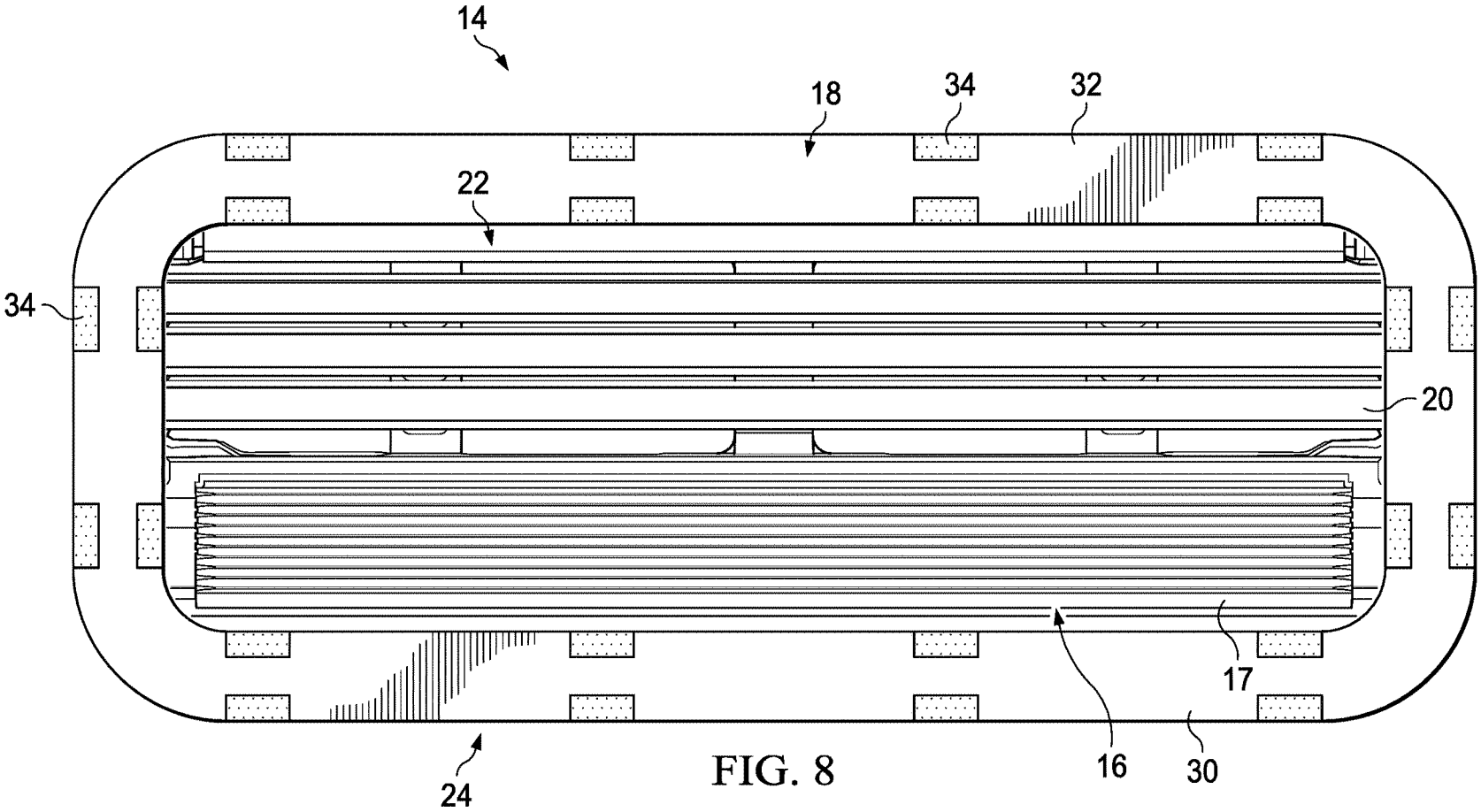
FIG. 8 is a perspective view of another razor cartridge of the present invention.
Figure 8A:
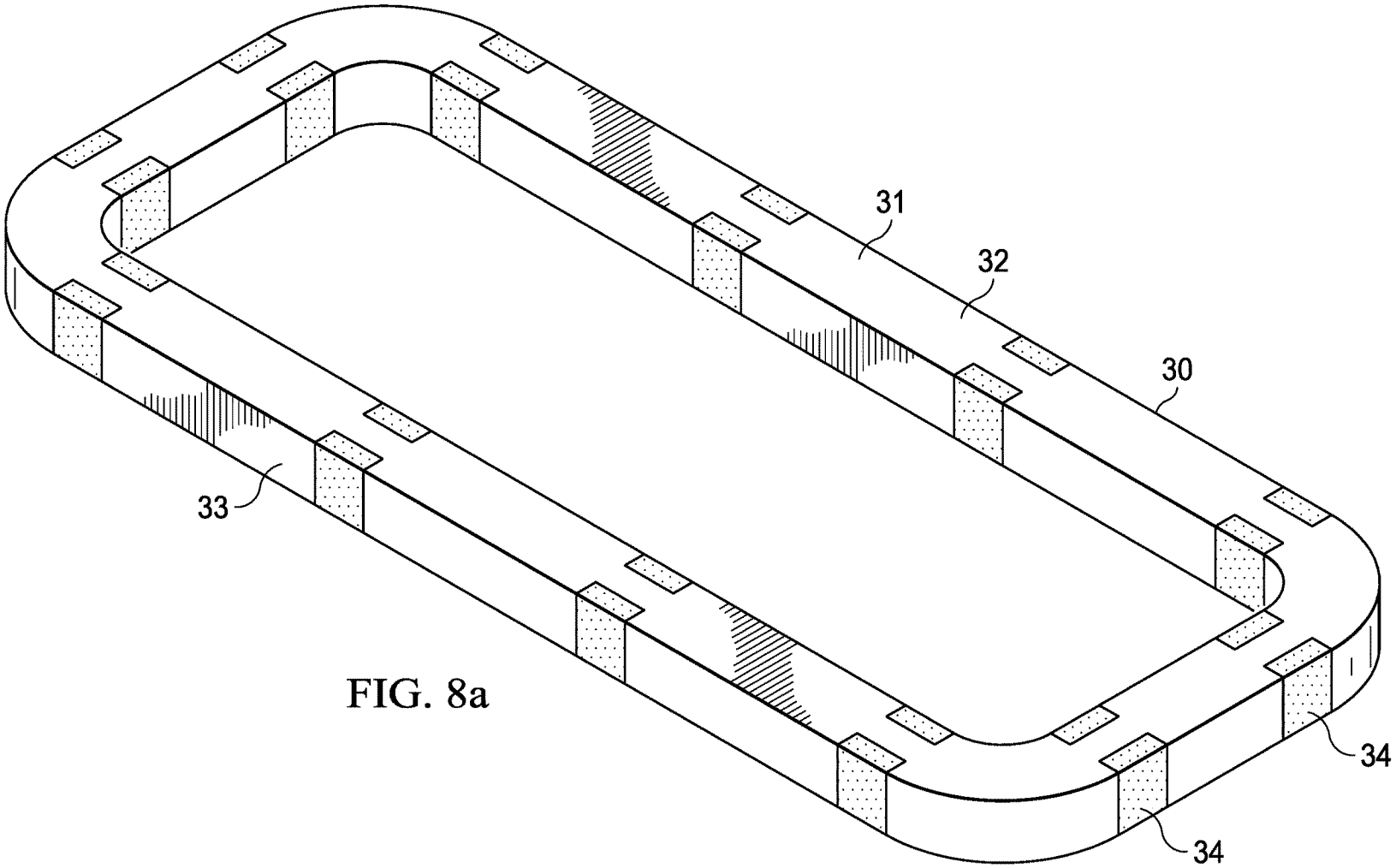
FIG. 8*a* is a perspective view of the lubricating member of the razor cartridge of FIG. 8.

Referring to FIGS. 8 and 8*a*, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating member 30 is positioned on the top surface 22 of the cartridge 14. Lubricating member 30 has a visible or top surface 32. The guard 16 includes flexible protrusions 17 in the form of flexible fins extending generally parallel to the one or more elongated blades 20.

The lubricating member 30 along with the guard 16, cap 18 and blades 20 form the skin engaging portion of the cartridge 14. The lubricating member 30 is located on the cartridge such that the lubricating member 30 contacts or engages the skin during the hair removal process. The lubricating member 30 is the form of a ring surrounding blades 20.

The visible surface 32 of lubricating member 30 includes printed support structure 34. The printed support structure 34 on the visible or top surface of lubricating member 30 is in the form of spaced apart segments. The printed support structure 34 is in a pattern. Referring to FIGS. 8 and 8*a*, the printed support structure 34 on the exterior surface 31 of the lubricating member 30 comprises a plurality of spaced apart segments positioned along the length of the visible or top surface 32 and non-visible or bottom surface 33 of lubricating member 30. The plurality of spaced apart support structures 34 on the guard from a pattern. As shown in FIG. 4, printed support structure 34 comprises a plurality of individual printed droplets 38.

Figure 9:
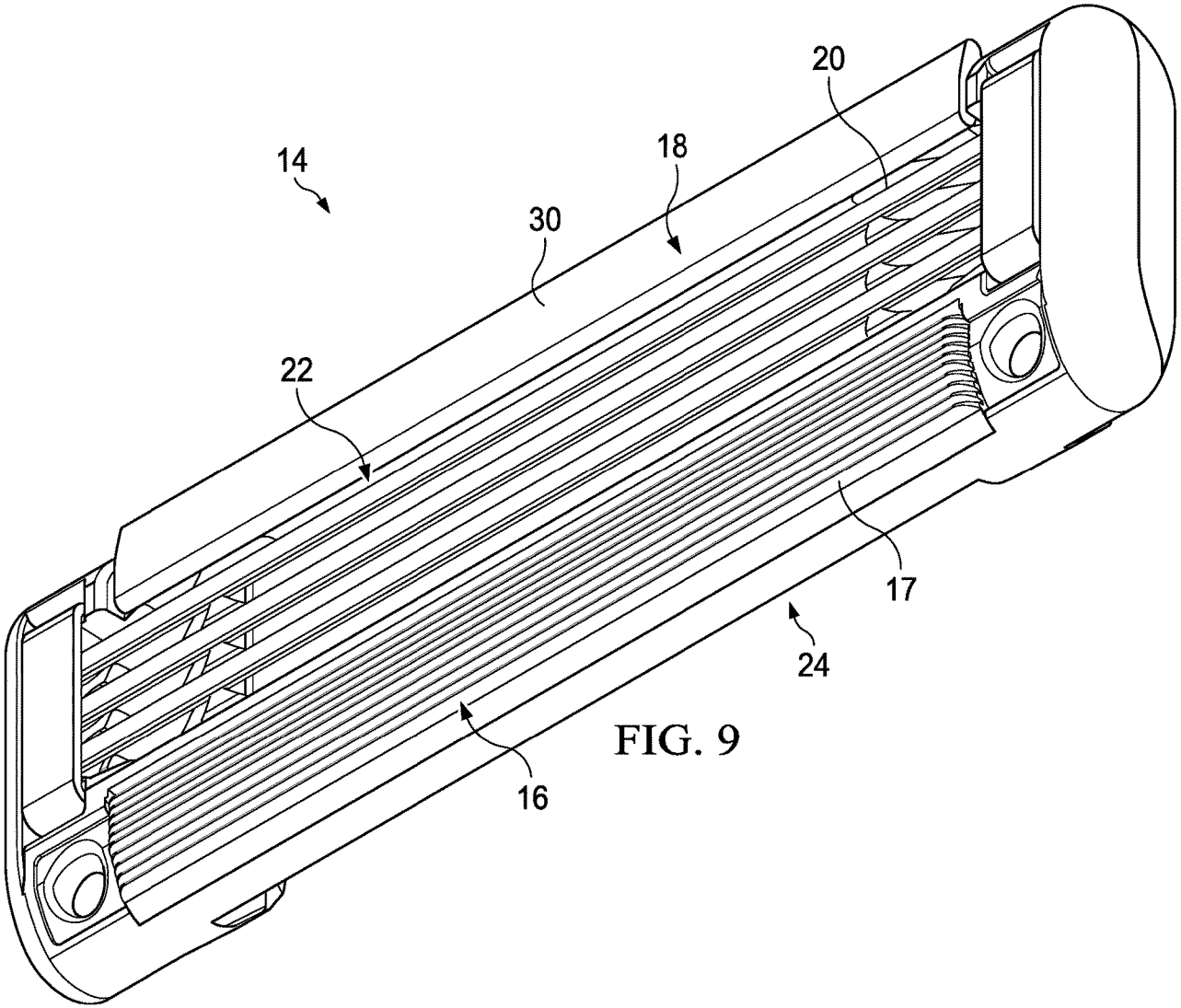
FIG. 9 is a perspective view of another razor cartridge of the present invention.
Figure 11:
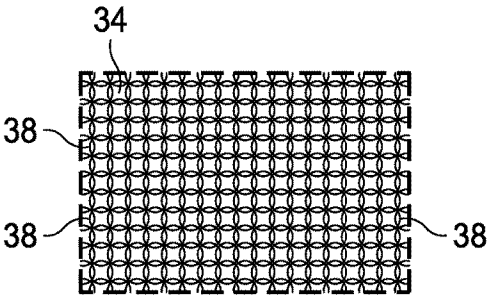
FIG. 11 is an enlarged view of a portion of the lubricating member shown in FIG. 10.
Figure 10:
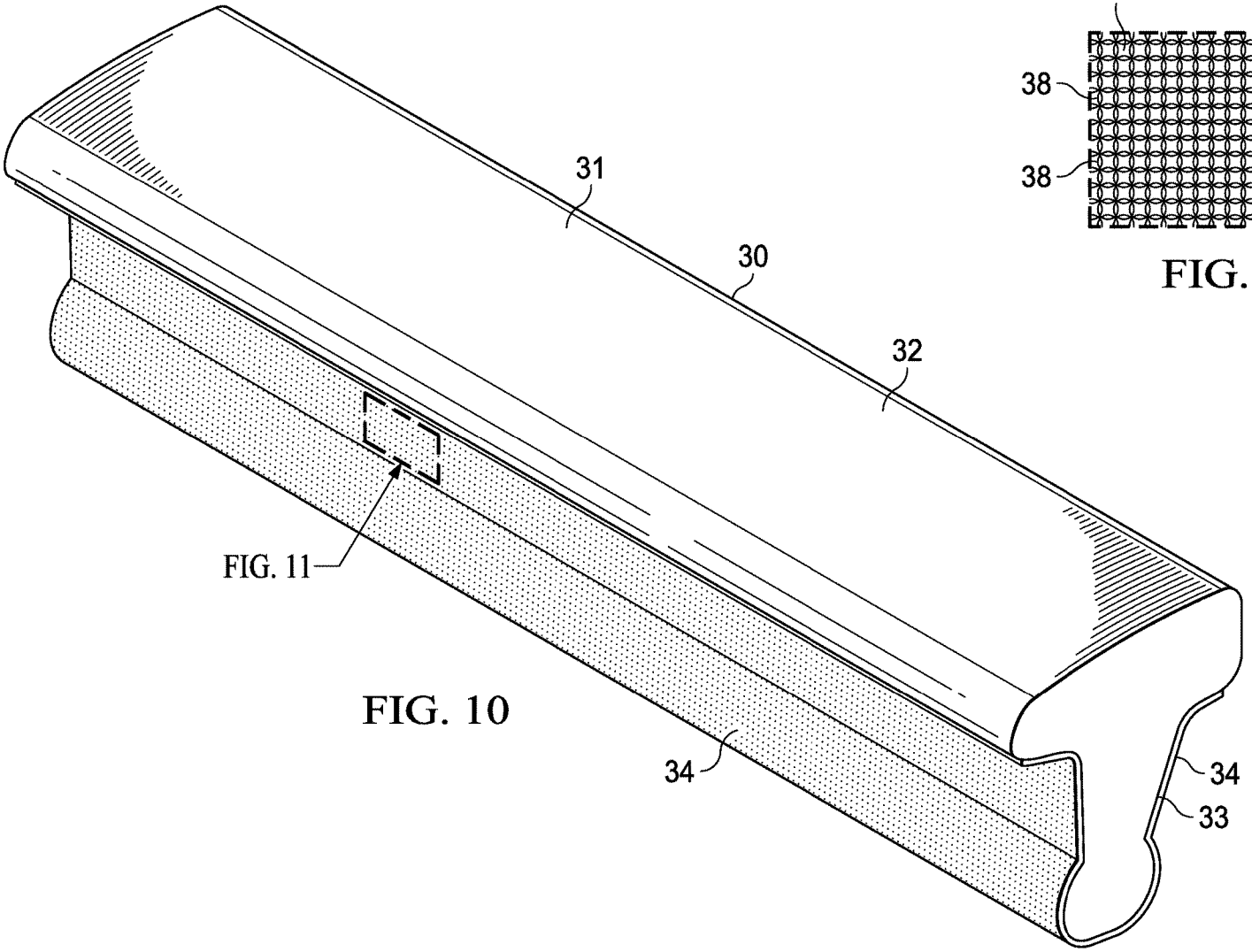
FIG. 10 is a perspective view of the lubricating member of the razor cartridge of FIG. 9.

Referring to FIGS. 9-11, the razor cartridge 14 includes a guard 16 positioned at a front portion of the cartridge 14, a cap 18 positioned at a back portion of cartridge 14, and blades 20 positioned between guard 16 and cap 18. Cartridge 14 includes a top surface 22 and an opposing bottom surface 24. Lubricating member 30 is positioned on the top surface 22 of the cartridge 14. Lubricating member 30 comprises an exterior surface 31. The guard 16 includes flexible protrusions 17 in the form of flexible fins extending generally parallel to the one or more elongated blades 20.

The lubricating member 30 along with guard 16, cap 18 and blades 20 form the skin engaging portions of the cartridge 14. The lubricating member 30 is located on the cartridge such that the lubricating member 30 contacts or engages the skin during the hair removal process. The lubricating member 30 is positioned aft of the blades 20. The lubricating member 30 is positioned on the cap 18.

The exterior surface 31 of lubricating member 30 comprises a visible or top surface 32 and a non-visible or bottom surface 33. The exterior surface 31 of lubricating member 30 includes a printed support structure 34. The non-visible surface or bottom surface 33 of the exterior surface 31 of lubricating member 30 includes a printed support structure 34. The printed support structure 34 is a solid or continuous printing covering the non-visible surface or bottom surface 33. As shown in FIG. 11, printed support structure 34 comprises a plurality of individual printed droplets 38. Adjacent individual droplets 38 overlap each other to provide the solid, continuous printing along the non-visible or bottom surface 33. Such a structure allows the lubricating member 30 to leach only from the visible or top surface 32.

Figure 12:
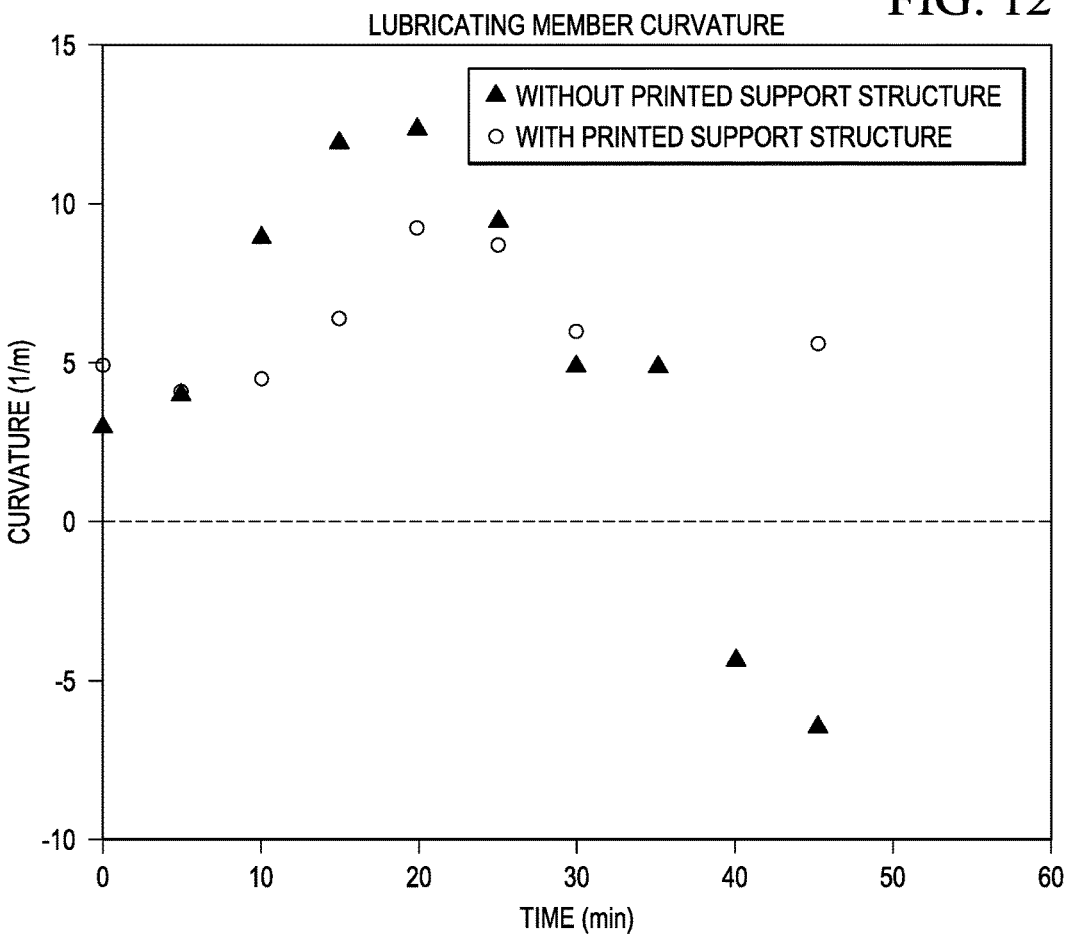
FIG. 12 is a graph showing the results of a test performed on lubricating members.

Several lubricating members were tested to determine the effect the printed support structure had on the lubricating member when immersed in water. Two different lubricating members were tested. Each lubricating member was of the same formula. The only variable was one lubricating member had no printed support structure and the other lubricating member had a printed support structure. The lubricating member with the printed support structure was similar to that shown in FIG. 10. Each lubricating member was immersed in water with curvature measurements taken at numerous time intervals. The results of the experiment are provided in FIG. 12. As can be seen, the lubricating member without a printed support structure experienced higher amounts of curvature both above and below the straight line than the lubricating member with a printed support structure. That is the lubricating members without a printed support structure bent in one direction in the early time periods and then bowed in the opposite direction at the later time periods. A lubricating member that bends or bows during shaving will likely provide an undesirable negative consumer experience.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A razor cartridge comprising;

a. a guard at a front portion of said cartridge, a cap at a back portion of said cartridge, at least one blade positioned between said guard and said cap, a top surface of the razor cartridge, and a lubricating member positioned at said top surface, said lubricating member comprising an exterior surface, said exterior surface comprises a visible surface exposed for contacting with a surface to be shaved during use and a non-visible surface positioned below the top surface of the razor cartridge and obstructed from a user's view so that the non-visible surface is not in contact with the surface to be shaved during use;

b. a separate printed support structure printed on said non-visible surface of said exterior surface of said lubricating member, said printed support structure providing structural integrity for said lubricating member.

2. The razor cartridge of claim 1, wherein said printed support structure is printed on said visible surface of said exterior surface of said lubricating member.

3. The razor cartridge of claim 1, wherein said lubricating member is positioned on said cap.

4. The razor cartridge of claim 1, wherein said lubricating member is positioned on said guard.

5. The razor cartridge of claim 1, wherein said lubricating member is a ring surrounding said blade.

6. The razor cartridge of claim 1, wherein the printed support structure is in the form of a pattern.

7. The razor cartridge of claim 1, wherein the printed support structure comprises a plurality of printed droplets.

8. The razor cartridge of claim 1, wherein said printed support structure covers from about 10% to about 90% of an area of the exterior surface.

9. The razor cartridge of claim 1, wherein said printed support structure comprises a UV curable ink.

10. A razor cartridge comprising;

a. a guard at a front portion of said cartridge, a cap at a back portion of said cartridge, at least one blade positioned between said guard and said cap, a top surface of the razor cartridge, and a lubricating member positioned at said top surface, said lubricating member comprising an exterior surface, said exterior surface comprises a top surface exposed for contacting with a surface to be shaved during use and a bottom surface; positioned below the top surface of the razor cartridge and obstructed from a user's view so that the non-visible surface is not in contact with the surface to be shaved during use b. a separate printed support structure on said bottom surface of said exterior surface of said lubricating member, said printed support providing structural integrity for said lubricating member.

11. The razor cartridge of claim 10, wherein said printed support structure is printed on said top surface of said exterior surface of said lubricating member.

12. The razor cartridge of claim 10, wherein said lubricating member is positioned on said cap.

13. The razor cartridge of claim 10, wherein said lubricating member is positioned on said guard.

14. The razor cartridge of claim 10, wherein said lubricating member is a ring surrounding said blade.

15. The razor cartridge of claim 10, wherein the printed support structure is in the form of a pattern.

16. The razor cartridge of claim 10, wherein the printed support structure comprises a plurality of printed droplets.

17. The razor cartridge of claim 10, wherein said printed support structure covers from about 10% to about 90% of an area of the exterior surface.

18. The razor cartridge of claim 10, wherein said printed support structure comprises a UV curable ink.

* * * * *